United States Patent [19]

Baker et al.

[11] 4,375,392

[45] Mar. 1, 1983

[54] BATH AND PROCESS FOR THE ELECTRODEPOSITION OF RUTHENIUM

[75] Inventors: Kenneth D. Baker, Bridgewater; Yvonne Rymwid, West Paterson, both of N.J.

[73] Assignee: Occidental Chemical Corporation, Warren, Mich.

[21] Appl. No.: 269,444

[22] Filed: Jun. 2, 1981

[51] Int. Cl.[3] ..... C25D 3/50; C25D 3/56

[52] U.S. Cl. ..... 204/43 N; 204/47

[58] Field of Search ..... 204/47, 43 N, 109, 123

[56] References Cited

U.S. PATENT DOCUMENTS

| | | | |
|---|---|---|---|
| 2,600,175 | 6/1952 | Volterra | 204/47 X |
| 3,625,840 | 12/1971 | Mason et al. | 204/47 |
| 3,630,856 | 12/1971 | Meyer | 204/43 N |
| 3,892,638 | 7/1975 | Stevens et al. | 204/43 N |

FOREIGN PATENT DOCUMENTS

| | | | |
|---|---|---|---|
| 49-7780 | 2/1974 | Japan | 204/47 |

OTHER PUBLICATIONS

F. H. Reid et al., Trans. Inst. Metal Finishing, 38, 45, (1961).

G. A. Conn, Plating, pp. 1038–1040, Sep. 1969.

*Primary Examiner*—G. L. Kaplan

*Attorney, Agent, or Firm*—Richard P. Mueller

[57] ABSTRACT

Improved baths for the electrodeposition of ruthenium metal on various substrates. The ruthenium metal baths are formulated with a complex of ruthenium metal and sulphamic acid wherein the molar ratio is one mole of ruthenium metal and from about 4 to 10 moles of sulphamic acid. For most purposes, certain selective metals are also present in the baths, which are maintained at a pH ranging from about 1.0 to 2.2. The process for utilizing said baths to plate substrates with essentially pure ruthenium metal is also described and claimed.

13 Claims, No Drawings

BATH AND PROCESS FOR THE ELECTRODEPOSITION OF RUTHENIUM

FIELD OF THE INVENTION

The present invention pertains to the electrodeposition of ruthenium metal on substrates, and relates more particularly to the attainment of stabilized ruthenium metal-containing electrolytes as well as ruthenium electroplating baths which will enable the deposition of substantial thicknesses on the substrates.

BACKGROUND OF THE INVENTION

The ruthenium electroplating baths heretofore proposed have been known for their instability with the undesirable effects of ruthenium oxide precipitation both during storage and actual electrodeposition operations. A serious loss of available ruthenium metal results. Furthermore, the known baths have a tendency to produce ruthenium metal deposits which crack at thicknesses over 0.5 microns. Some baths also require a semipermeable membrane type cell to prevent the formation of ruthenium tetraoxide at the anode.

It is for these reasons primarily that the ruthenium metal electroplates have not been widely accepted in the industry, although the properties of ruthenium metal as a contact and corrosion resistant material have been known for many years. It would be advantageous therefore to achieve an improved ruthenium electroplating bath; particularly since its current market price is about one-tenth the price of rhodium or gold, each of which could in many instances be replaced by ruthenium metal.

Previous ruthenium metal-containing electroplating baths are described, for example, in U.S. Pat. Nos. 2,057,638; 3,692,641; and 4,189,358. It also has been proposed to improve such baths by utilizing a complex formed by reacting ruthenium metal with sulphamic acid. These complexes have contained from 0.4 to 9 moles of sulphamic acid per mole of ruthenium metal. Unfortunately, the use of these known ruthenium-sulphamic acid complexes has still led to baths which exhibited poor stability in use as well as in storage and, equally deleterious, the readily by-product formation of ruthenium dioxide precipitates. The formation of ruthenium dioxide can also occur by hydrolysis during dilution or during pH adjustment with an alkaline material, e.g. alkali metal hydroxide, ammonium hydroxide, and the like. Representative U.S. patents which diclose complexes of sulphamic acid and ruthenium metal include U.S. Pat. Nos. 3,576,724; 3,625,840; 3,630,856; 3,793,162; 4,082,624; and 4,189,358.

OBJECTS OF THE INVENTION

One object of the present invention is to provide a ruthenium metal electrolyte or electroplating bath which avoids the difficulties encountered in the prior art baths.

Another object of the present invention is to provide a stable ruthenium metal electrolyte or electroplating bath which will not undesirably lead to the precipitation of insoluble ruthenium dioxide during storage or use.

A further object of the present invention is to provide a ruthenium-sulphamic acid complex electroplating bath which produces crack-free, essentially pure ruthenium metal deposits which may be greater than 0.5 micron in thickness.

These and other objects will become apparent from the ensuing description and illustrative embodiments.

SUMMARY OF THE INVENTION

The electroplating bath of this invention comprises, as one of its major ingredients a ruthenium-sulphamic acid complex wherein the mole ratio of the ruthenium metal to the sulphamic acid will be about 4 to 10, respectively. It is a further aspect of this invention to incorporate minor amounts of nickel, cobalt, tin, lead, magnesium or iron metals in the bath to ensure a low stress crack-free, essentially pure ruthenium metal deposit. By the term "essentially pure" as used herein it is intended to encompass a deposit which is about 99% ruthenium metal.

The electroplating baths of the present invention will generally be maintained at a pH of from about 0.1 to 2.4, with a pH within the range of about 1.0 to 2.2 being preferred. Maintenance and/or adjustment of the bath pH to achieve the desired value may be accomplished by the addition of any bath soluble alkaline or acidic material, depending upon whether the pH is to be raised or lowered.

Typically, to increase the pH, any bath soluble alkali metal carbonate, hydroxide or the like may be used, with the alkali metal hydroxides being preferred. Similarly, to decrease the pH, any bath soluble acid, such as hydrochloric, sulfuric, sulphamic acid or the like may be used, with sulphamic acid being preferred. It is to be appreciated that where the term "alkali metal" is used, it is intended to include ammonia, as well as sodium, potassium, lithium, cesium and rubidium.

The foregoing bath components or ingredients may be mixed together to form a saleable article of commerce which is then added to water with the required pH adjustment or all of the ingredients may be added to water to form the bath.

Another aspect of the present invention is the addition of one or more metals selected from nickel, cobalt, iron, magnesium, lead or tin to give a bath from which essentially pure ruthenium metal deposits can be attained at thicknesses even in excess of 0.5 microns without encountering cracking.

DETAILED DESCRIPTION OF THE INVENTION

As described above, one of the essential features of the present invention is to employ a ruthenium-sulphamic acid formed from 1 mole of ruthenium metal and at least 4 to 10 moles of sulphamic acid. The use of a molar ratio of 1 to 10 is especially preferred if one wants to achieve maximum bath stability during storage and use.

Conventional procedures, which do not constitute a feature of this invention, may be employed for preparing the ruthenium-sulphamic acid complex.

As noted above, another aspect of the present invention is the use of certain other metals in the bath. Although the exact reasons are not fully understood at this time, the use of these metal components appears to assist in producing crack-free ruthenium metal deposits at thicknesses even greater than 2.5 microns. Thus, the baths of this invention can not only exceed the 0.5 micron thickness limit of the prior art, but they can also be effectively employed to produce deposits that are even greater than 2.5 microns without encountering the cracking problem associated with the prior art ruthenium baths. Metals which can be employed for this purpose, are nickel, iron, tin, cobalt, lead, magnesium and mixtures thereof. These metals may be added in the form of their bath-soluble salts. Exemplary of such bath-soluble salts are the sulfates, acetates, halides, sulphamates, and the like.

The amount of ruthenium metal in the bath, in the form of the sulphamic acid complex, will be an amount which is at least sufficient to deposit ruthenium on the substrate to be plated, up to the maximum solubility of the complex in the bath. Typically, the amount of ruthenium will be from about 2 to 50 g/l, with amounts of about 4 to 6 g/l being preferred.

Where the other metals are added, as the bath soluble metal salts, the metals are typically present in amounts of from about 0.03 to 10 grams/liter, with amounts of from about 1 to 5 g/l being preferred. As has been previously noted, the bath pH is preferably from about 1.0 to 2.2, with a pH of from about 1.5 to 2.0 being particularly preferred.

It will be understood that the baths may also contain conventional additives to enhance the conductivity. Typical of these are the ammonium or alkali metal sulphamates. Minor amounts of this component are generally utilized, the preferred amounts being from about 10 to 30 g/l.

The baths of this invention may be operated at a current density up to that at which ruthenium tetroxide is evolved, with typical current densities being from about 2 to 100 amperes per square foot, and preferred current densities being from about 5 to 50 ASF. The bath may be operated at temperatures of from about 50 degrees C. up to the boiling point of the bath, with typical temperatures ranging from about 50 degrees to 80 degrees C., and preferred temperatures being from about 60 degrees to 75 degrees C.

By practicing the present invention essentially pure ruthenium metal can be deposited in thicknesses greater than 0.5 microns, without undesirable cracks being formed, on a variety of substrates including copper, nickel, silver, and steel, as well as alloys of these metals such as brass, bronze, stainless steel, and the like.

The present invention will be more fully understood by reference to the following illustrative embodiments:

EXAMPLE I

An electroplating bath was formulated from the following components:

| | Amount (g/l) |
|---|---|
| (a) Ruthenium metal, as the 1 to 10 mole sulphamate complex | 5 |
| (b) Ammonium sulphamate | 10 |
| (c) Nickel, as the sulphate salt | 2 |
| (d) Magnesium metal, as the sulphamate salt | 3 |

The pH of the bath was maintained at 1.6 to 2.2. A brass panel was immersed in said electrodeposition bath and plated with ruthenium metal at a current density of 10 ASF, and a temperature of about 70° C. After 25 minutes the deposit thickness was about 2.5 microns of essentially pure, crack-free ruthenium metal.

EXAMPLE II

Another electroplating bath was formulated from the following components:

| | Amount (g/l) |
|---|---|
| (a) Ruthenium metal, as the 1 to 4 mole sulphamate complex | 5 |
| (b) Ammonium sulphamate | 30 |
| (c) Tin, as stannous sulphate | 0.5 |

The pH of the bath was maintained at about 1.0 to 2.2. A brass panel was immersed in said electrodeposition bath and plated with essentially pure ruthenium metal at a current density of 20 ASF and a temperature of about 70° C. After 25 minutes the deposit thickness was about 2.5 microns of substantially crack-free, pure ruthenium metal.

EXAMPLE III

The bath of Example II was formulated with a 1 to 6 ruthenium metal sulphamic acid complex and with lead acetate being substituted for the stannous sulphate in varying amounts ranging from about 0.03 to 0.16 g/l. The resulting electrolytes operated efficiently under the conditions of Example II to produce essentially pure, crack-free ruthenium metal deposits in thickness of about 2.5 microns.

EXAMPLE IV

An electroplating bath was formulated from the following components:

| | Amount (g/l) |
|---|---|
| (a) Ruthenium metal, as the 1 to 10 mole sulphamate complex | 5 |
| (b) Ammonium sulphamate | 10 |

This bath was very stable during storage and its subsequent use, and produced essentially pure, crack-free ruthenium metal deposits of about 2.5 microns when operated as in Example II.

It will be also understood that the invention is subject to variations and modifications without departing from the scope of the invention described and illustrated above.

What is claimed is:

1. An aqueous electroplating bath for depositing ruthenium metal on various substrates which comprises a complex of ruthenium and sulphamic acid which contains from four to ten moles of sulphamic acid per mole of ruthenium, which complex is present in amount at least sufficient to deposit ruthenium on the substrate to be plated up to the maximum solubility of the complex in the bath; and a second metal component selected from nickel, cobalt, iron, tin, lead and magnesium, which second metal is present in the bath in amounts sufficient to produce a crack-free ruthenium metal deposit; said bath having a pH of from about 0.1 to 2.4.

2. The electroplating bath of claim 1 wherein the pH is within the range of about 1.0 to 2.2.

3. The electroplating bath of claim 1 wherein said second metal component is present in an amount ranging from about 0.03 to 10.0 g/l.

4. The electrolyte composition of claim 3 wherein the mole ratio of ruthenium metal to sulphamic acid in said complex is 1 to 10.

5. The electroplating bath of claim 3 wherein the amount of said second metal component is from about 1 to 5 g/l.

6. The electroplating bath of claim 5 wherein said metal is nickel.

7. The electroplating bath of claim 5 wherein said metal is tin.

8. The electroplating bath of claim 5 wherein said metal is lead.

9. The electroplating bath of claim 5 wherein said pH ranges from 1.5 to 2.0.

10. The electroplating bath of claim 3 wherein the ruthenium is present in an amount from about 2–50 grams per liter.

11. The electroplating bath of claim 1 wherein the alkaline sulphamate is present in an amount from about 10–30 grams per liter.

12. The electroplating bath of claim 11 wherein said alkaline sulphamate is ammonium sulphamate.

13. A method for electroplating metallic ruthenium on a substrate which comprises passing an electric current through a plating bath as claimed in claims 2, 3, 4, 5, 6, 7, 8, 9, 10 or 11, between an anode and a cathode for a period of time sufficient to produce the desired electro-deposit of ruthenium metal.

* * * * *